US007281333B2

(12) United States Patent
Caulliez et al.

(10) Patent No.: US 7,281,333 B2
(45) Date of Patent: Oct. 16, 2007

(54) FOOT GAUGE

(75) Inventors: Guillaume Caulliez, Wasquehal (FR); Patrick Doby, Attiches (FR)

(73) Assignee: Promiles, Villeneuve d'Ascq (FR)

( * ) Notice: Subject to any disclaimer, the term of this patent is extended or adjusted under 35 U.S.C. 154(b) by 0 days.

(21) Appl. No.: 11/298,448

(22) Filed: Dec. 12, 2005

(65) Prior Publication Data

US 2006/0130345 A1 Jun. 22, 2006

(30) Foreign Application Priority Data

Dec. 21, 2004 (FR) ..... 04 13674

(51) Int. Cl.
*A43D 1/00* (2006.01)

(52) U.S. Cl. ..... 33/3 A; 33/3 R; 600/592

(58) Field of Classification Search ..... 33/3 A, 33/3 B, 3 C, 3 R, 512, 515; 600/592
See application file for complete search history.

(56) References Cited

U.S. PATENT DOCUMENTS

| | | | | | |
|---|---|---|---|---|---|
| 33,307 | A | * | 9/1861 | Lane | 33/3 B |
| 802,448 | A | * | 10/1905 | Goodbar | 33/3 R |
| 996,910 | A | * | 7/1911 | Dauker | 33/3 C |
| 1,067,987 | A | * | 7/1913 | Kerr | 33/3 B |
| 1,582,636 | A | * | 4/1926 | Clarke | 33/3 R |
| 1,607,359 | A | * | 11/1926 | Morse | 33/3 C |
| 1,837,809 | A | | 12/1931 | Delhaye | |
| 1,973,435 | A | * | 9/1934 | Hiss | 33/3 B |
| 2,078,368 | A | * | 4/1937 | Brannock | 33/3 B |
| 2,163,661 | A | * | 6/1939 | Brown | 33/3 R |
| 2,332,292 | A | * | 10/1943 | Bliss | 33/3 A |
| 2,522,899 | A | * | 9/1950 | Schlaugh et al. | 33/3 B |
| 2,554,285 | A | * | 5/1951 | Westbrook, Sr. | 33/3 C |
| 2,657,463 | A | * | 11/1953 | Spencer | 33/3 A |
| 2,782,504 | A | * | 2/1957 | Del Pesco | 33/3 C |
| 4,635,366 | A | | 1/1987 | Fohrman et al. | |
| 7,086,168 | B2 | * | 8/2006 | Spivey | 33/515 |

FOREIGN PATENT DOCUMENTS

| | | |
|---|---|---|
| GB | 590195 A | 7/1947 |
| GB | 696073 A | 8/1953 |

* cited by examiner

*Primary Examiner*—G. Bradley Bennett
*Assistant Examiner*—Travis Reis
(74) *Attorney, Agent, or Firm*—Kenyon & Kenyon LLP

(57) ABSTRACT

A device for providing assistance in measuring the size of the foot. The foot gauge has a foot support plate having a single graduated scale per foot; a transverse first bearing face for the heel; a longitudinal second bearing face for the inside of the foot; and a moving assembly comprising a "transverse" first abutment for coming into contact with the front end of the foot, at the toes, and a "longitudinal" second abutment for coming into contact with the outside of the foot, and a measurement identifier member the size on the graduated scale. The moving assembly moves in a rectilinear or curved direction that is oblique relative to the longitudinal second bearing face, e.g. at an angle a, in its rectilinear portion, that lies in the range of 13° to 20°, and is preferably equal to 14.3°.

7 Claims, 2 Drawing Sheets

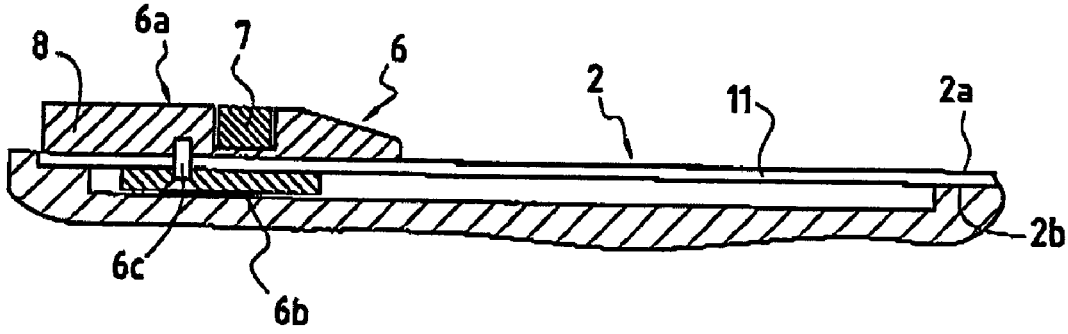
FIG.2
FIG.3
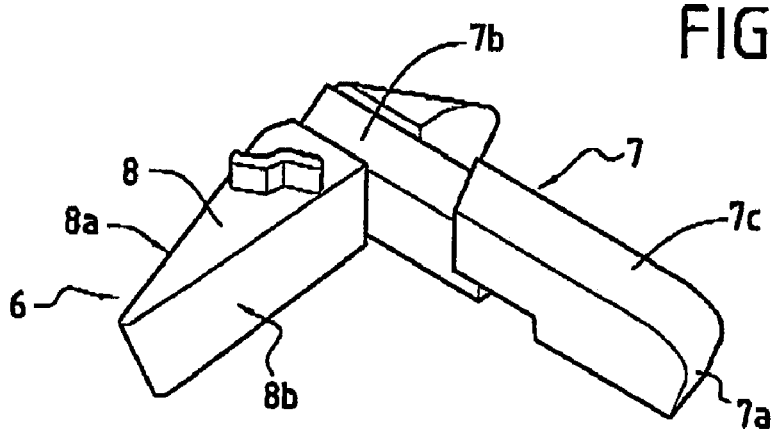
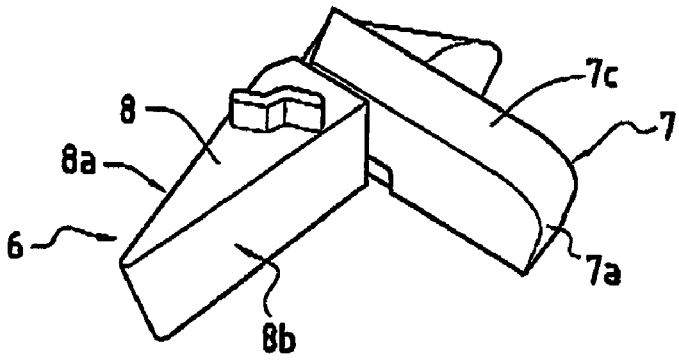
FIG.4

FOOT GAUGE

BACKGROUND OF THE INVENTION

In the most simple versions, a foot gauge comprises a plate on which the user places a foot, the foot bearing firstly against a first abutment extending transversely for the heel and secondly against a second abutment extending longitudinally for the inside of the foot. The plate carries a graduated scale enabling the user to see the size of the foot from indications that are immediately visible on the graduated scale beyond the portion of the scale that is hidden by the presence of the foot.

In that version, the graduated scale has a longitudinal disposition, and the size corresponds strictly to the length of the foot.

In a more elaborate version, known from document FR 2 763 221, the particular disposition of the graduated scale enables size to be measured in a way that takes account both of the length of the foot and of its width.

Nevertheless, such a gauge lacks precision, insofar as the size value read by the operator can for any one foot vary as a function of the position of the operator relative to the plate, since in order to ensure that an exact measurement is taken the operator must take up a position that is strictly vertical above the support plate.

To mitigate that drawback, proposals have been made to fit a foot gauge with a moving assembly including a transversely-extending abutment for coming into contact with the longest toe, like a height gauge for measuring a user's height.

In a more elaborate version, the foot gauge has a moving assembly comprising not only a transverse abutment as described above, but also a longitudinal abutment for coming into contact with the outside of the foot, together with means for identifying size. One such gauge is described in document FR 2 233 955.

In that document, the gauge has means for measuring the length of the foot and means for measuring the width of the foot, said means being mechanically or electrically connected to a foot-size indicator in which the size that is specified depends both on the length and on the width of the foot.

In document FR 2 233 955, once the foot has been pressed against the support plate, the operator performs two distinct operations to cause firstly the transverse abutment to slide into contact with the longest toe, and secondly the longitudinal abutment to slide to come into contact with the outside face of the foot.

OBJECTS AND SUMMARY OF THE INVENTION

The present invention proposes a foot gauge that does not require two distinct operations, but which enables a foot-size measurement to be obtained in a single operation.

In known manner, the invention provides a device or gauge for measuring the size of the foot, the device comprising:

a) a foot support plate having a single graduated scale per foot;

b) a transverse first bearing face for the heel;

c) a longitudinal second bearing face for the inside of the foot; and d) a moving assembly comprising a "transverse" first abutment for coming into contact with the front end of the foot, at the toes, and a "longitudinal" second abutment for coming into contact with the outside of the foot, and measurement identifier means for identifying the size on the graduated scale.

In characteristic manner, according to the invention, the moving assembly moves in a rectilinear or curved direction that is oblique relative to the longitudinal second bearing face. In addition, measurement of size occurs as soon as one of the two abutments, either the transverse or the longitudinal abutments, comes into contact with the foot, respectively against its front end or against its outside.

Thus, while the moving assembly is being moved, the longitudinal and transverse abutments move simultaneously and the measurement is taken as soon as one of the abutments comes into contact with the foot. If it is the transverse abutment that comes into contact with the front face, generally with the big toe, then the size corresponds to the conventional approach based on the length of the foot. However, if it is the longitudinal abutment that comes into contact with the outside of the foot, then size is determined as a function of the width of the foot, and as a result it corresponds to a shoe of length that is longer than the actual length of the foot.

The first abutment is said to be "transverse" even if its direction is not strictly perpendicular to the longitudinal second abutment. Specifically, said abutment preferably slopes slightly upwards at an angle of about 3° to 5° in order to take account of the variety of toe shapes depending on whether the foot is an "Egyptian" foot, a "peasant" foot, or a "Greek" foot. In an Egyptian foot the big toe projects in front of the other four toes; in a peasant foot, the ends of the big toe and at least the immediately adjacent toe lie in the same plane; while in the Greek foot, the big toe is shorter than the toe immediately adjacent thereto. This inclination of the transverse abutment serves to adjust the size of a Greek foot artificially to a slightly greater size that would have been given thereto without said inclination.

In addition, the direction in which the moving assembly is moved corresponds to the statistical ratio between the length and the width of the foot as a function of foot size. It turns out that this ratio is generally constant for the feet of adults and children, and corresponds to a direction that is rectilinear. However this statistical ratio is not constant for the feet of young children, and corresponds to a direction that may be curved for smaller sizes.

Preferably, the direction DD' in which the moving assembly moves relative to the longitudinal second bearing face, in its rectilinear portion, is at an angle $\alpha$ relative thereto lying in the range 13° to 20°.

In a variant embodiment, the measurement identifier means are in line with the longitudinal abutment of the moving assembly. It will be understood that the graduated scale carried on the support plate presents the same oblique direction as the direction of the moving assembly relative to the longitudinal second bearing face.

In a variant embodiment, the moving assembly has both a top portion moving above the plate and a bottom portion moving under the plate, with the top and bottom portions being interconnected by a connection piece. In addition, the plate includes an oblique slot defining the travel direction of the moving assembly, said slot allowing the connection piece to pass therethrough.

Under such circumstances, the bottom face of the plate may optionally be provided with a slideway encompassing the oblique slot and guiding the bottom portion of the moving assembly while it moves.

In a variant embodiment, the transverse abutment is provided with slider means making it suitable to move relative to the longitudinal abutment when the transverse abutment comes to bear against the longitudinal second bearing face, during movement of the moving assembly.

As can be seen more clearly from the examples illustrated below, it is necessary for the transverse abutment to have a length that is sufficient to come into contact with the front side of the foot for feet of maximum size. Nevertheless, because of the oblique travel direction of the moving assembly, it can happen that such movement is prevented by the transverse abutment and the longitudinal bearing face coming into contact. The particular disposition described above enables this drawback to be avoided and makes it possible to provide a foot gauge covering a very wide range of sizes, for example sizes 26 to 50 in the French standard.

It should be observed that the graduated scale carried by the plate can be made so as to mention different ranges of sizes as standardized for different countries. Under such circumstances, the measurement-indicator means consists in an oblong hole making it possible to see the standardized size values along an alignment.

BRIEF DESCRIPTION OF THE DRAWINGS

The present invention can be better understood on reading the following detailed description of an embodiment of a foot gauge comprising a moving assembly that moves obliquely relative to the longitudinal direction of the foot, and as shown in the accompanying drawings, in which:

FIG. 2 is a diagrammatic longitudinal section of the moving assembly on axis II-II of FIG. 1; and FIGS. 3 and 4 are diagrammatic perspective views of the moving assembly in the high position on the plate for feet of large size (FIG. 3) and in the low position on the plate for feet of small size (FIG. 4).

MORE DETAILED DESCRIPTION

Figure 1:
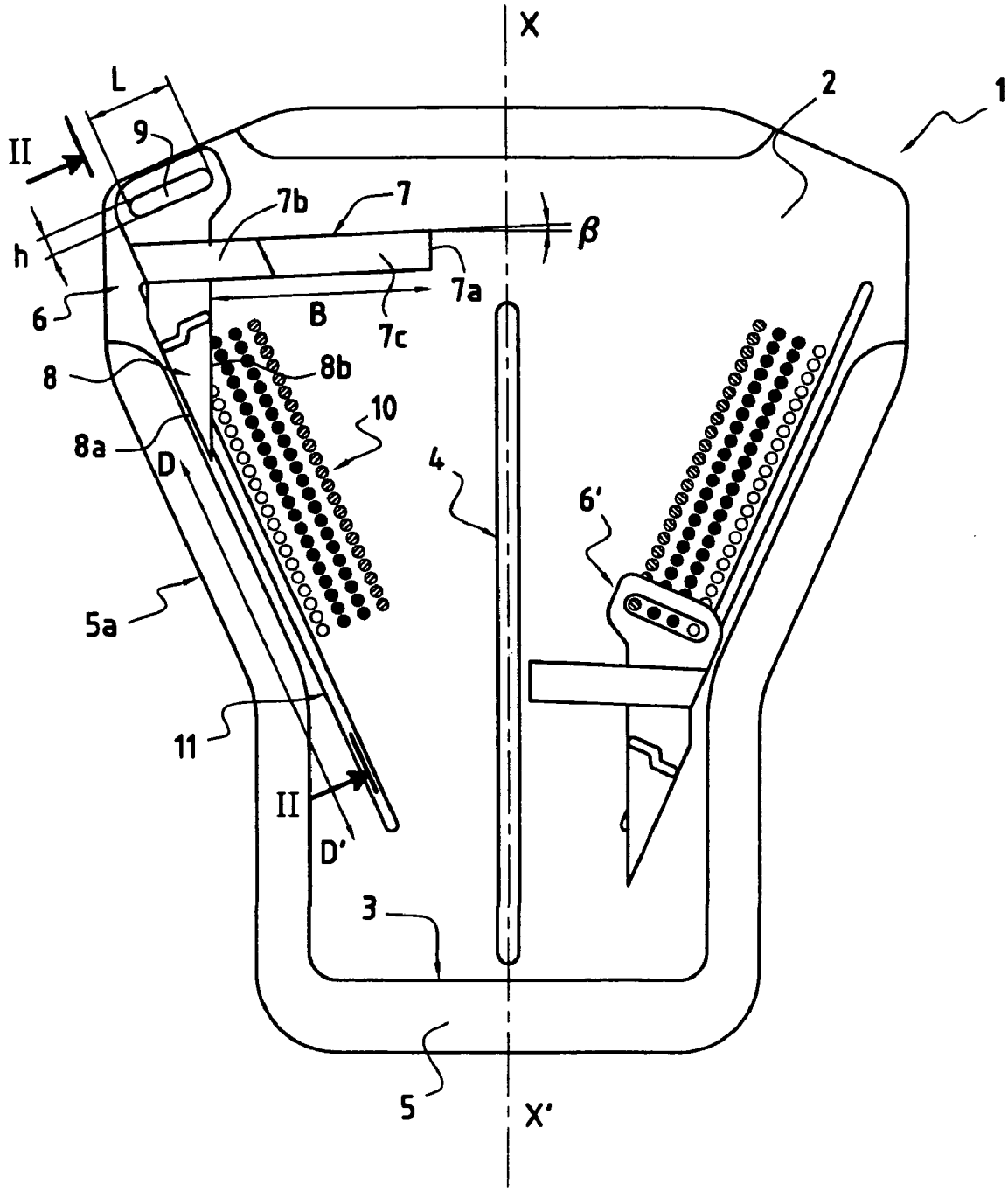
FIG. 1 is a diagrammatic plan view of the top of the foot gauge.

The embodiment of a foot gauge described below is for measuring the size of both feet of a user. In order to facilitate the description, only one side of the gauge is described, corresponding to measuring only one of the two feet, it being understood that the other side is entirely symmetrical thereto about a middle longitudinal axis XX' of the gauge, and enabling the size of the other foot to be measured.

The foot gauge 1 comprises a plate 2 for supporting the foot of the user, a transverse first bearing face 3 for coming into contact with the heel of the user's foot, and a longitudinal second bearing face 4 for coming into contact with the inside of the user's foot.

On the top face 2*a* of the plate 2 there is a graduated scale 10 that is applied by printing or by using a plastics film or by any other means, the scale corresponding to the different sizes that can be measured by means of the gauge 1. In the example shown, there are four graduated scales corresponding to a juxtaposition of measurements firstly in application of the European, US, and British standards, and secondly in centimeters.

The plate 2 and the two bearing faces 3 and 4 may be thermoformed by molding. The transverse first bearing face 3 consists in the inside wall extending perpendicularly to the plane of the plate 2 of a rim 5 surrounding part of the periphery of the plate 2.

The gauge 1 further comprises a moving assembly 6 which can be moved in a direction DD' which in the example shown is rectilinear and at an angle $\alpha$ with the middle axis XX' of the gauge, i.e. with the direction of the longitudinal second bearing face 4. This angle $\alpha$ preferably lies in the range 13° to 20°. It is preferably equal to 14.3°.

In its top portion 6*a* that moves over the top face 2*a* of the plate 2, the moving assembly 6 (FIG. 2) comprises firstly a transverse abutment 7 for coming into contact with the front end of the user's foot, at the toes, when the foot is positioned on the plate 2, and secondly a longitudinal abutment 8 for coming into contact with the outside of the foot.

The transverse abutment 7 (FIG. 1) slopes upwards at a small angle $\beta$ of about 4° relative to a perpendicular to the longitudinal bearing face 4.

This moving assembly 6 also includes measurement identifier means for identifying the size of the foot, which means are specifically constituted by an opening 9 formed through the top portion of the moving assembly 6, beyond the transverse abutment 7.

In the example shown, the opening 9 is oblong in shape and of length L and height h that are determined in such a manner as to enable one complete portion of the graduated scale corresponding to a single size to be viewed. As can be seen clearly in FIG. 1, the general direction of the graduated scale corresponds to the travel direction DD' of the moving assembly 6, which direction is perpendicular to the longitudinal middle axis of the oblong opening 9.

Once the user has placed a foot on the plate 2 with the heel pressed against the transverse first bearing face 3 and the inside of the foot pressed against the longitudinal second bearing face 4, it suffices for the operator to move the moving assembly 6 until one of its two abutments 7 and 8 comes into contact with the foot, i.e. the transverse abutment 7 coming into contact with the front face at the toes, or the longitudinal abutment 8 coming into contact with the outside of the foot. Once such contact is made, it is possible to view the graduated scale through the orifice 9 and read off the size corresponding to the shoe that is appropriate for the user's foot.

In the example shown in FIG. 2, the moving assembly 6 is constituted by the above-described top portion 6*a*, a bottom portion 6*b* disposed against the bottom face 2*b* of the plate, and a connection piece 6*c* which interconnects the top and bottom portions 6*a* and 6*b*. This connection piece 6*c* passes through a slot 11 formed in the plate 2 along the oblique direction DD'.

Preferably, in order to guide the bottom portion 6*b* on the moving assembly 6, two side walls are formed on the bottom face 2*b* of the plate 2 to constitute slides for the bottom portion 6*b* on either side of the slot 11.

FIG. 1 shows both moving assemblies 6 and 6' for the left foot and the right foot of the user disposed on either side of the longitudinal axis XX' of the gauge 1, the first moving assembly 6 being in the high position towards the largest sizes of the graduated scale, while the second moving assembly 6' is shown in the low position, towards the smallest sizes of the graduated scale.

When a foot is positioned on the plate 2 in order to measure its size, the foot is contained completely within a space that is defined laterally by the longitudinal abutment 8 and the longitudinal bearing face 4, at the bottom by the transverse bearing face 3, and at the top by the transverse abutment 7.

The length B of the transverse abutment 7 beyond the longitudinal abutment 8 must be sufficient to ensure that when the moving assembly 6 is in the high position, said transverse abutment 7 can come into contact with the longest toe of a user having the largest size on the graduated scale 10. When the moving assembly 6 goes from the high position as shown on the left in FIG. 1 to the low position as shown on the right in FIG. 1, by moving obliquely along the direction DD', the extreme tip 7*a* of the transverse abutment 7 comes to bear against the longitudinal abutment 4. This constitutes a limit on the range of sizes that can be measured by the graduated scale. Nevertheless, in order to avoid this drawback, provision is made for the transverse abutment 7 to be mounted slidably relative to the longitudinal abutment 8 in the moving assembly 6. More precisely, in the example shown, the transverse abutment 7 is made up of two elements 7*b* and 7*c* that slide telescopically relative to each other. The first element 7*b* is stationary relative to the longitudinal abutment 8, and the second element 7*c* can move relative to the first element 7*b* while compressing an internal spring (not shown in the figures). In the high position, the second element 7*c* of the longitudinal abutment 7 is pushed away by the spring so that the length B shown on the left-hand side of FIG. 1 is the maximum length for the transverse abutment 7.

During movement of the moving assembly 6 along the direction DD', the extreme tip 7*a* of the second element 7*c* comes into contact with the longitudinal second bearing face 4, but movement can be continued because the internal spring is compressed, thereby allowing the second element 7*c* to move towards the longitudinal abutment 8, as shown on the right-hand side of FIG. 1.

In the example shown, in the low position, the second element 7*c* completely covers the first element 7*b* of the transverse abutment 7, with the internal spring being fully stretched, such that it is no longer possible to move the moving assembly beyond this position, which corresponds to measuring the smallest size on the graduated scale.

In this example, for reasons of compactness and also for reasons of appearance, the peripheral rim 5 of the plate 2 presents a side portion 5*a* that is also oblique, extending parallel to the direction DD' of the slot 11. The longitudinal abutment 8 is triangular in shape with its outside face 8*a* opposite from its inside face 8*b* that comes into contact with the foot also being parallel to the direction DD'. During movement of the moving assembly 6, this outside face 6*a* of the longitudinal abutment 8 remains parallel to the side portion 5*a* of the peripheral rim 5, and at a short distance therefrom.

In another variant embodiment of a transverse abutment 7 mounted to slide relative to the longitudinal abutment 8, the side portion 5*a* of the peripheral rim 5 is further away from the outside face 8*a* of the longitudinal abutment 8. In addition, the transverse abutment 7 presents a total length that remains constant during the movement of the moving assembly 6. The effect of sliding is to push back a portion of the transverse abutment 7 beyond the longitudinal abutment 8, into the space situated between the outside face 8*a* of the longitudinal 8 and the side portion 5*a* of the peripheral rim 5.

What is claimed is:

1. A device or gauge for measuring foot size, the device comprising:

a) a foot support plate having a single graduated scale per foot;

b) a transverse first bearing face for the heel;

c) a longitudinal second bearing face for the inside of the foot; and d) a moving assembly comprising a "transverse" first abutment for coming into contact with the front end of the foot, at the toes, and a "longitudinal" second abutment for coming into contact with the outside of the foot, and measurement identifier means for identifying the size on the graduated scale;

wherein the moving assembly moves in a rectilinear or curved direction that is oblique relative to the longitudinal second bearing face, the graduated scale presents the same oblique direction, and wherein size is measured as soon as one of the transverse and longitudinal abutments comes into contact with the foot, respectively with the front end or the outside.

2. A device according to claim 1, wherein the transverse abutment is upwardly inclined at an angle .beta. of about 3.degree to 5.degree., and preferably equal to 4.degree.

3. A device according to claim 1, wherein the angle .alpha. of the travel direction DD' of the moving assembly relative to the longitudinal second bearing face, in its rectilinear portion, lies in the range 13.degree. to 20.degree., and is preferably equal to 14.3.degree.

4. A device according to claim 1, wherein the measurement identifier means are in line with the longitudinal abutment in the moving assembly.

5. A device according to claim 1, wherein the moving assembly comprises a top portion moving above the plate and a bottom portion moving under the plate, which top and bottom portions are connected together by a connection piece, and wherein the plate includes an oblique slot defining the movement direction of the moving assembly, the connection piece passing through the slot.

6. A device according to claim 5, wherein the bottom face of the plate is provided with a slideway on either side of the oblique slot and guiding the bottom portion of the moving assembly during its movement.

7. A device according to claim 1, wherein the transverse abutment is provided with slider means enabling it to move relative to the longitudinal abutment when said transverse abutment comes to bear against the longitudinal second bearing face during the movement of the moving assembly.

* * * * *

UNITED STATES PATENT AND TRADEMARK OFFICE

CERTIFICATE OF CORRECTION

PATENT NO. : 7,281,333 B2
APPLICATION NO. : 11/298448
DATED : October 16, 2007
INVENTOR(S) : Guillaume Caulliez et al.

It is certified that error appears in the above-identified patent and that said Letters Patent is hereby corrected as shown below:

| Column | Line | |
|---|---|---|
| 1 | 1 | Add under the title of invention "Foot Gauge," --The present invention relates to a device for providing assistance in measuring the size of the foot, commonly referred to as a "foot gauge."-- |

Signed and Sealed this

Thirteenth Day of May, 2008

JON W. DUDAS
*Director of the United States Patent and Trademark Office*